US005451014A

United States Patent [19]

Dare et al.

[11] Patent Number: 5,451,014

[45] Date of Patent: Sep. 19, 1995

[54] SELF-INITIALIZING INTERNAL GUIDANCE SYSTEM AND METHOD FOR A MISSILE

[75] Inventors: James M. Dare, St. Charles; Jerome A. Farm, Richmond Heights, both of Mo.; Barry C. Mears, Auburn, Ill.

[73] Assignee: McDonnell Douglas, St. Louis, Mo.

[21] Appl. No.: 249,438

[22] Filed: May 26, 1994

[51] Int. Cl.[6] ..... F41G 7/36

[52] U.S. Cl. ..... 244/3.15; 244/3.2; 244/3.21

[58] Field of Search ..... 244/3.15, 3.21, 3.2

[56] References Cited

U.S. PATENT DOCUMENTS

| | | | |
|---|---|---|---|
| 3,205,820 | 9/1965 | McCorkle | 102/49 |
| 3,305,194 | 2/1967 | Conard et al. | 244/3.21 |
| 3,411,736 | 11/1968 | Kelly | 244/3.15 |
| 3,497,161 | 2/1970 | Kissinger et al. | 244/3.2 |
| 3,951,358 | 4/1976 | DeLano et al. . | |
| 4,146,196 | 3/1979 | Schultz . | |
| 4,442,431 | 4/1984 | Bleakney . | |
| 4,541,591 | 9/1985 | Chadwick et al. | 244/3.15 |
| 4,627,586 | 12/1986 | Krumins et al. . | |
| 4,928,570 | 5/9190 | Esterlin et al. . | |
| 5,148,734 | 9/1992 | Lilly . | |
| 5,209,437 | 5/1993 | Fantar | 244/164 |

*Primary Examiner*—Charles T. Jordan
*Assistant Examiner*—Christopher Keith Montgomery
*Attorney, Agent, or Firm*—Bell, Seltzer, Park & Gibson

[57] ABSTRACT

A guidance system for internally controlling the flight path of a missile includes a guidance platform having dispersion control means mounted on the guidance platform for detecting acceleration of the missile due to lift and side forces. The dispersion control means includes dispersion detection means to calculate the velocity and position errors relative to a drag-only trajectory from the detected acceleration due to the lift and side forces. The internal guidance system also includes missile positioning means for controlling the position of the missile platform to substantially eliminate the velocity and position errors. The guidance system also includes level finding means for determining a substantially horizontal level axis and the orientation of the missile relative to a level axis. The missile positioning means also performs other functions such as missile leveling in which the wings-level axis of the missile is aligned to the level axis. Accordingly, the position of a free-falling missile may be internally controlled to increase the targeting accuracy of the missile without initialization of the missile from the launch platform.

23 Claims, 3 Drawing Sheets

SELF-INITIALIZING INTERNAL GUIDANCE SYSTEM AND METHOD FOR A MISSILE

FIELD OF THE INVENTION

The present invention relates to guidance systems for missiles, and, more particularly, to autonomous guidance systems for internally controlling the flight paths of missiles.

BACKGROUND OF THE INVENTION

For many years, aircraft have deployed missiles during flight. The missiles have principally been designed to contact a target on the ground, i.e., an air-to-surface missile, or in the air, i.e., an air-to-air missile. In an attempt to control the flight of the missiles, various guidance systems and methods have been developed.

Initially, missiles were unguided and simply dropped from aircraft during flight. The missiles would then free-fall to earth subject to the prevailing gravitational and aerodynamic forces. Thus, following the missile's deployment, the flight pattern of the missile was not controlled. Accordingly, the accuracy with which such missiles contacted the target was relatively low since, even though the crew deploying the missile would generally consider the speed of the aircraft and any known wind conditions in selecting the deployment coordinates for the missile, the missile was subject to numerous unknown sources of error.

The inability to control the flight path of a deployed missile and to correct for errors introduced by unknown sources, such as intermittent high-level wind currents, was unsatisfactory. For example, even a missile which misses its target by only a small distance may either be totally ineffective or may cause inadvertent harm. In either event, however, the missile would have been unnecessarily expended and the target would remain unscathed.

Numerous modern missile applications prefer to launch missiles from remote locations, i.e., locations located many thousands of feet both vertically and horizontally from the intended target, in order to avoid detection or possible retaliation. Missiles capable of such remote deployment are considered to have a long "stand off". The launch of missiles from remote locations further exacerbates the targeting deficiencies of unguided missiles due to the increased duration of the sources of error acting upon the missile during its extended flight from its deployment to the target.

In an attempt to control the flight path of missiles, inertial guidance systems have been placed onboard some missiles. Initialization of such inertial guidance systems is required prior to launch of the missiles. For example, guidance system alignment and target information, such as the coordinates of the launch and target locations is typically downloaded from the launch platform, such as an airplane, via a data interface to the missile prior to launch. Following launch, the onboard guidance system controls the flight path of the missile via the missile's external control surfaces to effectively steer the missile from the launch coordinates to the target coordinates while compensating for external forces.

Such onboard guidance systems typically require the deploying aircraft to be equipped with fire control avionics to download the proper data to the missile prior to its launch. In addition, an appropriate interface between the aircraft avionics and the guidance system of the missile is required. Therefore, the number of properly equipped aircraft and aircraft weapon stations from which such missiles may be launched is limited. In addition, while fire control avionics and an appropriate interface could be added to more aircraft, the cost of the aircraft modifications would be prohibitive.

Another attempt to provide increased accuracy for guided missiles employs sensor systems, such as radar, on the missiles. These missiles are typically referred to as terminal homing missiles. The sensor system of the missile searches for a designated target, and upon recognition of the designated target, controls the flight of the missile such that it impacts upon the target.

Although missiles with inertial guidance and/or terminal homing have improved the accuracy with which targets may be attacked, these missiles typically require expensive electrical and data interfaces with their air or ground launch platforms or complex sensor systems. Thus, it would be desirable to have a missile guidance system that did not require a launch platform to be equipped with an expensive or complex electrical and data missile interface and did not require a complex sensor system.

SUMMARY OF THE INVENTION

It is therefore an object of the invention to provide a novel method and apparatus for guiding a missile.

It is another object of the invention to provide a method and apparatus for guiding a missile which has no electrical or data interface with its associated launch platform.

These and other objects are provided according to the invention by a guidance system for controlling the flight path of a missile adapted to be carried by and launched from a platform, such as an aircraft, ship, or ground-based launch platform. The guidance system includes dispersion control means for controlling the flight path to follow a drag-only, or ballistic, trajectory. The dispersion control means includes dispersion detection means for detecting the acceleration of the missile due to lift and side forces and for calculating the velocity and position errors of the missile relative to a drag-only flight path due to the detected accelerations. The velocity and position errors are substantially eliminated by a missile positioning means which is responsive to the dispersion detection means and produces countervailing accelerations directed opposite those imparted by the lift and side forces. By substantially eliminating the velocity and position errors relative to a drag-only trajectory due to lift and side aerodynamic forces, the flight path of the free-falling missile is internally controlled to increase its targeting accuracy, relative to that of a missile without an internal guidance system, without initialization of the missile by its launch platform via an expensive data interface and without incorporation of a complex sensor system.

The guidance system also includes level finding means for determining a substantially horizontal level axis and the orientation of the missile relative to the substantially horizontal level axis. The level axis also provides a reference axis for subsequent guidance of the missile.

The orientation of the missile establishes three mutually perpendicular body axes $X_B$, $Y_B$ and $Z_B$. The $X_B$ axis extends forward along the longitudinal axis of the missile. The $Y_B$ axis extends outwardly from the starboard side of the missile and the $Z_B$ axis extends through the lower skin of the missile. The orientation of the missile body axes at activation time establishes three mutually perpendicular reference axes, namely, $X_R$, $Y_R$ and $Z_R$, which remain fixed in orientation thereafter.

The missile preferably includes a guidance platform upon which the guidance system is mounted. The dispersion detection means preferably includes a plurality of accelerometers mounted on the guidance platform for measuring acceleration along the $Y_B$ axis due to side forces and along the $Z_B$ axis due to lift forces. The dispersion detection means also includes means to measure the three-dimensional rotation of the missile, such as a plurality of gyroscopes mounted on the guidance platform. The direction of the rotating body axes relative to the non-rotating reference axes may be determined from the measurement of the three-dimensional rotation of the missile.

The dispersion detection means also preferably includes integration means for repeatedly integrating the accelerations measured along the $Y_B$ and $Z_B$ axes to determine the resulting velocity and position errors along the $X_R$, $Y_R$, and $Z_R$ axes relative to a drag-only, or ballistic, trajectory. Thus, the accelerations, resulting from the side and lift forces and resolved along the $X_R$, $Y_R$, and $Z_R$ axes, may be integrated once to determine the velocity error along each reference axis and twice to determine the position error along each reference axis. The dispersion detection means also preferably includes means for generating signals indicative of the measured acceleration, and preferably the velocity and position errors introduced thereby, due to the lift and side forces.

The level finding means also preferably includes a plurality of gyroscopes to measure the three-dimensional rotation of the missile. In particular, a sequence of $X_B$ axis positions over time is determined which defines a plane in which the missile is falling. A unit vector perpendicular to the plane in which the missile is falling is determined which defines the level axis for the missile guidance. The level finding means also preferably determines the orientation of the missile relative to the level axis. In addition, the level finding means preferably includes means for generating a signal indicative of the direction of the level axis and a signal indicative of the orientation of the missile relative to the level axis. Once the level axis and the orientation of the missile thereto is determined, the flight of the missile may be controlled by a guidance system, such as the guidance system of the present invention or a conventional missile guidance system.

The guidance system of the present invention also includes missile positioning means which advantageously includes a plurality of control affectors, typically control surfaces, and a plurality of actuating means attached to the plurality of control surfaces for controlling the position of the control surfaces in response to the signals generated by the guidance system. Most preferably, the control surfaces are outwardly extending control surfaces which are spaced at substantially equal angular increments about the periphery of the missile. In one embodiment, the plurality of control surfaces includes four control surfaces spaced about the periphery of the missile at approximately 90 degree increments.

In addition, the actuating means is preferably a plurality of actuators with one actuator associated with each of the plurality of control surfaces. The actuating means also preferably includes actuator control means for receiving the signals generated by the guidance system, and, based upon those signals, for transmitting control signals to the plurality of actuators for controlling the positions of the control surfaces.

In operation, the guidance system for controlling the flight path of the free-falling phase of a missile repeatedly detects the acceleration on the missile due to lift and side forces. The dispersion detection means then calculates the velocity and position errors with respect to a drag-only trajectory from the detected accelerations. Thereafter, the missile positioning means adjusts the positions of the missile control surfaces, preferably via actuators, in order to compensate for the detected accelerations due to lift and side forces and to substantially eliminate the velocity and position errors. Simultaneously, the level finding means repeatedly determines a substantially horizontal level axis and also provides signals to the missile leveling means. If required, the missile leveling means provides signals to the missile positioning means to adjust the control surfaces of the missile in order to align the missile such that the missile is in a predetermined, typically upright, orientation.

Advantageously, the acceleration detection and level axis determination, as well as the adjustment of the control surfaces to compensate for the detected accelerations and to properly align the missile to a predetermined orientation is repeated. Accordingly, the free-falling missile is internally controlled such that the accuracy of the missile is significantly improved, relative to an uncontrolled missile, without initialization of the missile's guidance system from the launch platform prior to deployment.

Thus, missiles having a guidance system of the present invention may be deployed from a launch platform which does not have a data interface with the missile and which, consequently, cannot download the deployment and target coordinates or additional flight information thereto. Further, since missiles having a guidance system of the present invention will have a controlled flight path, such missiles may be deployed from a launch platform at a relatively great distance from the target in order to provide improved safety of deployment and decreased probability of detection of the deploying aircraft.

DESCRIPTION OF THE PREFERRED EMBODIMENTS

The present invention now will be described more fully with reference to the accompanying drawings, in which a preferred embodiment of the invention is shown. This invention may, however, be embodied in many different forms and should not be construed as limited to the embodiments set forth herein; rather, this embodiment is provided so that this disclosure will be thorough and complete and will fully convey the scope of the invention to those skilled in the art. Like numbers refer to like illustrations throughout.

Figure 1:
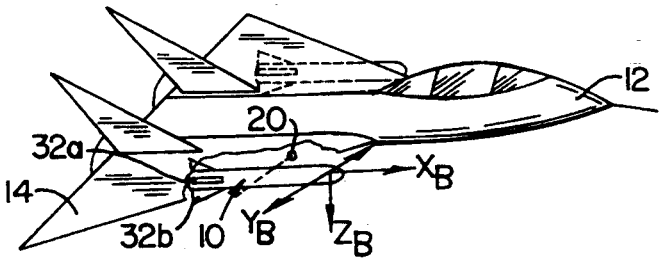
FIG. 1 is a perspective view of an aircraft carrying a missile according to the present invention prior to deployment.

Referring now to FIG. 1, a missile 10 according to the present invention is illustrated. The missile 10 is carried by an aircraft 12, such as an airplane or a helicopter, prior to its deployment. The missile 10 may be attached to the aircraft 12 such as on the lower surface of an airplane's wing 14, by conventional mounting and launching fixtures known to those skilled in the art. The mounting and launching fixture need not have an electrical interface through which to communicate or download information to the missile 10. Instead, the missile 10 may merely be mechanically held in position by the mounting and releasing fixture such that it may be released at a location determined by the launch airplane.

Further, a missile 10 incorporating an internal guidance system of the present invention is typically unpropelled following deployment. However, the missile 10 may include an engine or other means for powering the missile so as to provide the missile with even greater stand-off capabilities such that the missile 10 may be deployed from even more remote locations from the intended target.

Figure 2:
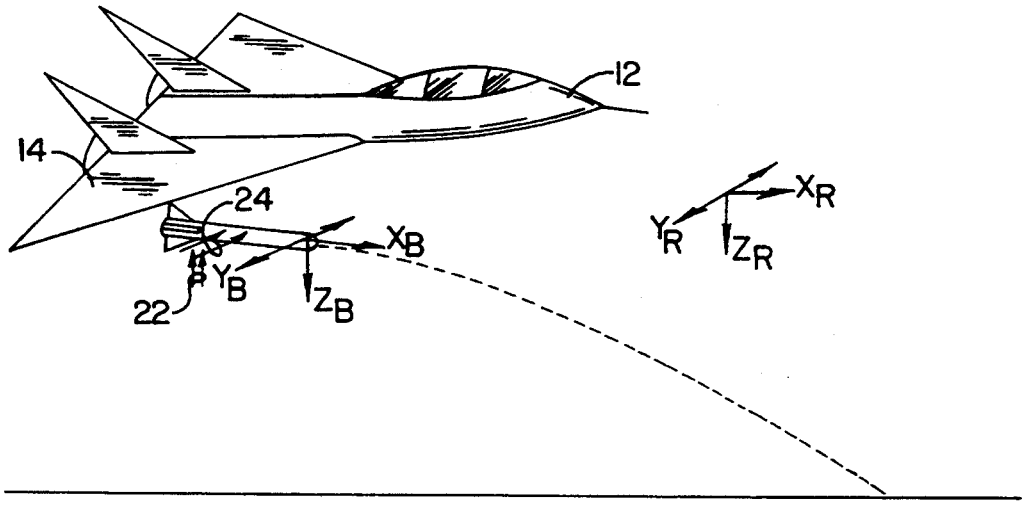
FIG. 2 is a perspective view of an aircraft and a missile according to the present invention immediately following deployment of the missile.

The missile 10 is deployed from the aircraft 12 as illustrated in FIG. 2. Following deployment, the orientation of the free-falling missile establishes three mutually perpendicular body axes, $X_B$, $Y_B$, and $Z_B$. The $X_B$ body axis extends forward along the longitudinal axis of the missile 10. The $Y_B$ body axis extends through the starboard side of the missile 10 while the $Z_B$ body axis extends through the lower skin 18 of the missile 10.

In addition, the orientation of the missile 10 at the time of its activation establishes three mutually perpendicular reference axes, $X_R$, $Y_R$ and $Z_R$. The activation time of the missile 10 is defined as the time at which the missile 10 has been launched, the hardware implementing the guidance system has received power, and the guidance operations, hereinafter described, have been initiated. Activation may occur via a lanyard pull or devices known to those skilled in the art to detect the separation of a missile from its launch platform. More particularly, at the time of activation, the $X_R$ reference axis is aligned with the $X_B$ body axis while the $Y_R$ reference axis is aligned with the $Y_B$ body axis and the $Z_R$ reference axis is aligned with the $Z_B$ body axis.

Because the missile may be launched from any orientation and may roll between the time of launch and the activation time of the guidance system, the reference axes are not necessarily oriented horizontally and vertically. While the reference axes $X_R$, $Y_R$ and $Z_R$ remain fixed in orientation as illustrated in FIG. 2, the body axes $X_B$, $Y_B$ and $Z_B$ will vary as the missile 10 falls since the body axes are determined by the orientation of the missile 10 at any particular time following deployment.

Figure 3:
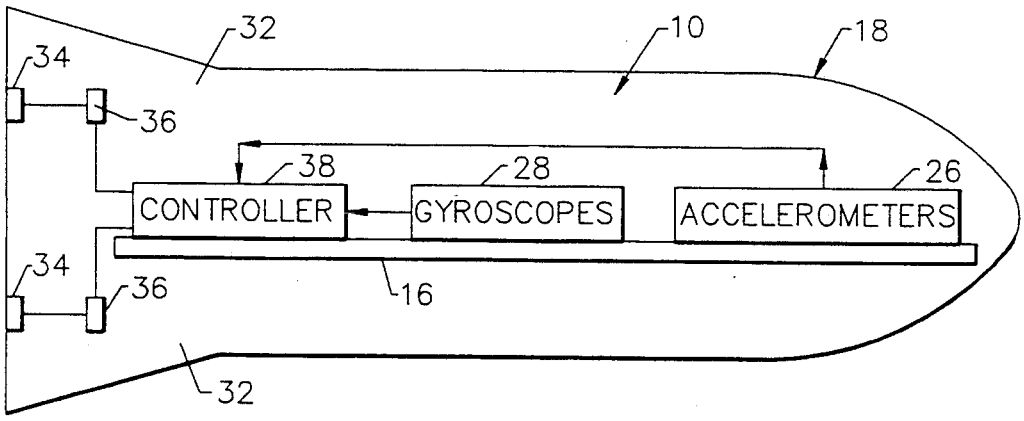
FIG. 3 is a cross-sectional view of the missile schematically illustrating the guidance system.

As illustrated in FIG. 3, the missile 10 preferably includes a guidance platform 16 housed within the outer skin 18 of the missile 10 upon which the components of the missile 10 are mounted. The missile 10 has a predetermined wings-level axis 20 as illustrated in FIG. 1 to provide a reference direction for orienting the missile.

Drag forces on the missile 10 are oriented in a direction along the longitudinal axis of the missile 10. Gravitational forces also act upon the missile 10 in a downward direction. Drag and gravitational forces are predictable to a large extent and may be taken into account in planning the flight path of the missile 10 prior to its launch. In addition to drag forces and gravitational forces, the missile 10 may be affected by lift forces 22 or side forces 24 as illustrated in FIG. 2. Lift and side forces are due to varying airflow conditions which tend to displace the missile 10 from a ballistic, or drag-only, flight path and, unless negated, will prevent the missile 10 from flying a drag-only flight path or the drag-only portion of its intended flight path. Accordingly, in order to allow the missile 10 to follow a drag-only flight path, or at least the drag-only portion of its flight path, the missile 10 must compensate for the lift and side forces.

This compensation is provided according to the present invention by an internal guidance system for controlling the flight path of the missile 10 as illustrated in schematic form in FIG. 3. In addition to the guidance platform 16 as previously described, an internal guidance system of the missile 10 includes dispersion control means having dispersion detection means for detecting acceleration of the missile 10 due to lift and side forces caused by airflow, but not gravitational forces. The guidance system of the present invention also includes missile positioning means, responsive to the dispersion detection means, to control the dispersion of the missile 10 due to the detected acceleration due to lift and side forces, as explained hereinafter.

Figure 4A:
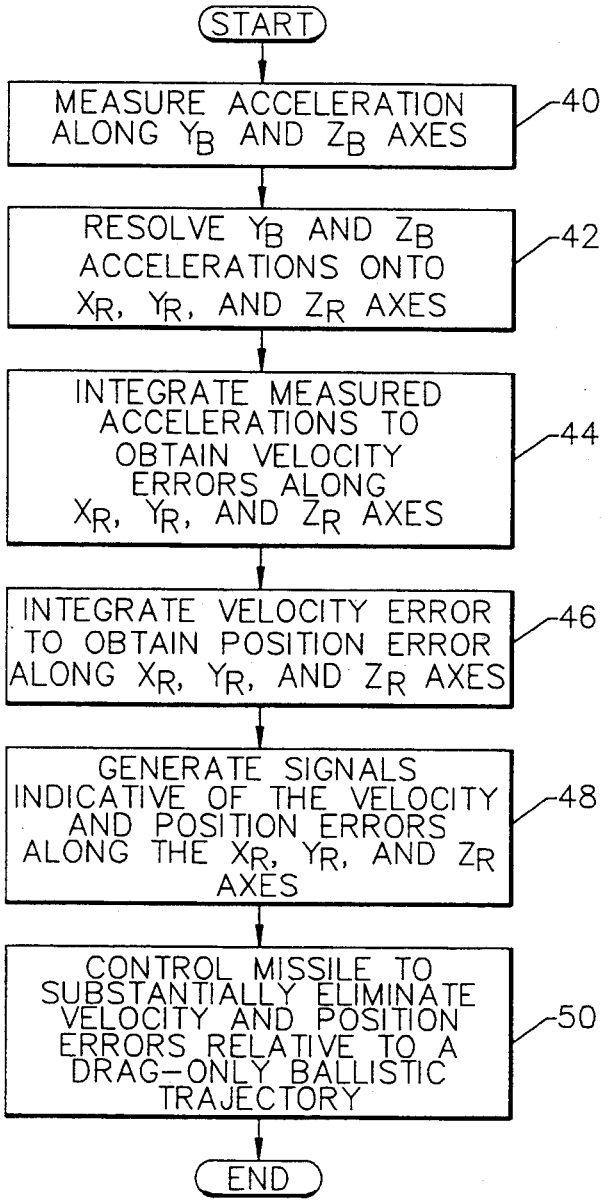
FIGS. 4A and 4B are flow charts illustrating the operations performed repeatedly by the dispersion detection means and level finding means, respectively, of a missile guidance system according to the present invention.

Preferably, the dispersion detection means includes a plurality of accelerometers 26 mounted on the guidance platform 16 for measuring the acceleration along the $Y_B$ axis due to side forces and along the $Z_B$ axis due to lift forces as schematically illustrated in FIG. 3 and in block 40 of FIG. 4A. The plurality of accelerometers 26 measure the accelerations on the missile 10 due to aerodynamic forces, but cannot measure gravitational acceleration on the missile 10. Most preferably, a first accelerometer is mounted on the guidance platform 16 for measuring the acceleration along the $Y_B$ axis due to side forces and a second accelerometer is mounted on the guidance platform 16 for measuring the acceleration along the $Z_B$ axis due to lift forces.

The dispersion detection means also preferably includes means for measuring the three-dimensional rotation of the missile. This rotation measuring means preferably includes a plurality of gyroscopes 28 mounted on the guidance platform 16 to measure rotation of the $X_B$, $Y_B$, and $Z_B$ body axes with respect to the $X_R$, $Y_R$, and $Z_R$ reference axes. Based upon the measured rotation of the body axes from the reference axes, the measured accelerations along the $Y_B$ and $Z_B$ axes are resolved along the $X_R$, $Y_R$, and $Z_R$ axes as shown in block 42 of FIG. 4A.

For example, with respect to the $Y_B$ axis, the acceleration measured along the $Y_B$ axis is resolved along the $X_R$, $Y_R$, and $Z_R$ axes. The acceleration measured along the $Z_B$ axis is similarly resolved along the $X_R$, $Y_R$, and $Z_R$ axes. A total acceleration along the $X_R$ axis, for example, is then determined by adding the components of the $Y_B$ and $Z_B$ accelerations which were resolved along the $X_R$ axis. Total accelerations along the $Y_R$ and $Z_B$ axes are similarly determined.

As illustrated in blocks 44 and 46 in FIG. 4A, the dispersion detection means also preferably includes acceleration integration means for determining the velocity and position errors along the $X_R$, $Y_R$, and $Z_R$ axes due to the measured accelerations along the $Y_B$ and $Z_B$ axes. The acceleration integration means separately integrates the total acceleration along each of the $X_R$, $Y_R$, and $Z_R$ axes. This integration provides velocity errors along the $X_R$, $Y_R$, and $Z_R$ axes. By further integrating the velocity errors, position errors along the $X_R$, $Y_R$, and $Z_R$ axes are obtained. The dispersion detection means also preferably includes means for generating signals indicative of the measured accelerations, and, more preferably, the velocity and position errors introduced thereby along the $X_R$, $Y_R$, and $Z_R$ axes due to the lift and side forces as shown in block 48 of FIG. 4A.

Figure 4B:
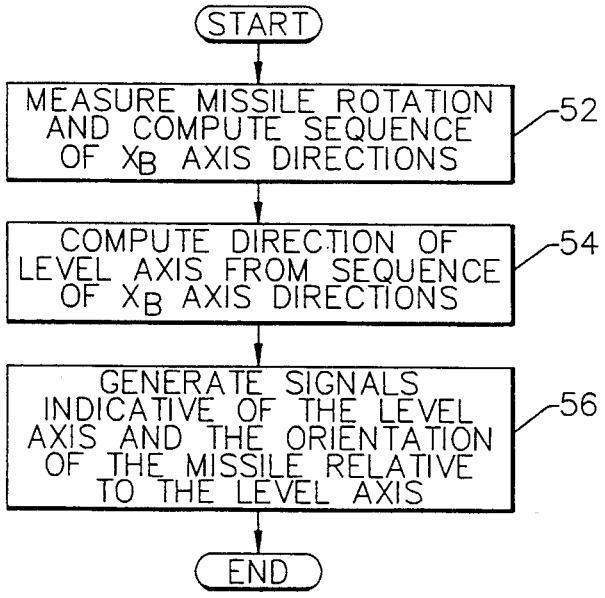
Figure 5:
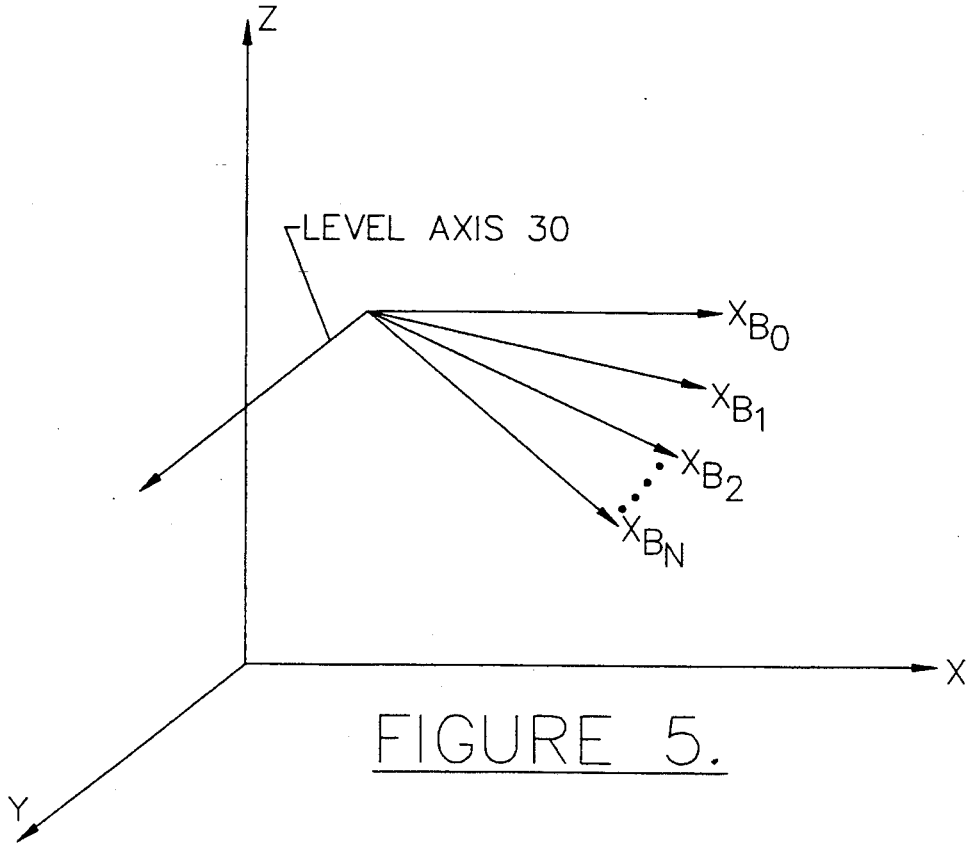
FIG. 5 is a graph of the sequence of $X_B$ axis directions of the missile according to the present invention taken over time including the level axis determined based upon the sequence of directions.

The internal guidance system of the missile 10 also includes level finding means for determining a substantially horizontal level axis 30 of FIG. 5. Preferably, the level finding means includes a plurality of gyroscopes 28 mounted on the guidance platform 16 which measure the rotational motion of the $X_B$, $Y_B$, and $Z_B$ body axes with respect to the $X_R$, $Y_R$, and $Z_R$ reference axes. These measurements permit the direction of the $X_B$ body axis relative to the $X_R$, $Y_R$, and $Z_R$ reference axes to be determined which, in turn, is utilized to determine the orientation of the level axis 30 as illustrated in blocks 52 and 54, respectively, of FIG. 4B.

The level finding means preferably repeatedly determines the direction of the $X_B$ body axis relative to the $X_R$, $Y_R$ and $Z_R$ reference axes. Consequently, a plurality of $X_B$ axis directions, computed over time, sweeps through and defines a plane in which the missile 10 is falling as graphically illustrated in FIG. 5. As further illustrated by the increasing numeric subscript, the $X_B$ body axis generally points increasingly downward over time since the $X_B$ axis follows the longitudinal axis of the missile 10 which points increasingly downward as the missile 10 accelerates downward due to the attractive force of gravity.

The level axis unit vector is determined from the plurality of $X_B$ body axis positions computed over time. More particularly, the level axis unit vector is perpendicular to the plane defined by the plurality of $X_B$ body axis positions as illustrated in FIG. 5. This plane is substantially vertical because the dispersion control means maintains the missile 10 in a drag-only ballistic trajectory.

Various methods can be employed to determine the direction of the level axis unit vector. For example, a least squares fit method may preferably be performed to determine the unit vector which is most perpendicular to the least squares fit of the $X_B$ axis positions. Alternatively, the level axis unit vector may be computed as the vector cross product of a unit vector in the direction of the most recent $X_B$ axis position and the unit vector in the direction of the initial $X_B$ axis position. Still further, the missile roll attitude may be controlled until only one of the $Y_B$ axis or $Z_B$ axis gyroscopes, usually the $Y_B$ axis gyroscope, senses the tipover rate of the missile 10 as it falls under the influence of gravity. According to this method, the level axis 30 is defined as the line co-linear with the input axis of the gyroscope sensing the tipover rotation rate.

The level finding means preferably includes means for generating signals indicative of the direction of the level axis 30 relative to the $X_R$, $Y_R$, and $Z_R$ reference axes. The level finding means also preferably includes means for generating signals indicative of the orientation of the missile 10 relative to the level axis 30 as shown in block 56 of FIG. 4B.

The internal guidance system of the present invention also includes missile positioning means, responsive to the dispersion detection means or other conventional guidance systems, if activated, as described hereinafter, for controlling the position and orientation of the missile 10. For the drag-only phase of a missile's flight path, the position and orientation of the missile 10 are preferably controlled such that velocity and position errors relative to a drag-only, ballistic flight path are canceled as shown in block 50 of FIG. 4A. Thus, the acceleration of the missile 10 due to the lift and side forces is substantially eliminated.

If other guidance systems have been activated, the position and orientation of the missile 10 are preferably controlled by the missile positioning means in a manner appropriate for the particular guidance system as described hereinafter. Accordingly, the position of a missile 10 is internally controlled to increase the accuracy of the missile 10 without initialization of the missile guidance system from the aircraft or other launch platform.

Once the level finding means has determined the level axis 30, the missile 10 may continue to employ the guidance system of the present invention to follow a drag-only, ballistic trajectory. Accordingly, the guidance system of the present invention may control the flight path of a missile 10, along a drag-only trajectory, from its deployment to its terminal attack of the designated target. Alternatively, the missile 10 may employ other guidance systems known to those skilled in the art if a trajectory, other than a drag-only, ballistic trajectory, is desired. Still further, the guidance system of the present invention and a conventional guidance system may be employed to produce a multi-phase flight path having one or more phases in which the missile 10 follows a drag-only trajectory. As known to those skilled in the art, the particular guidance system(s) utilized once the level axis 30 has been determined will depend on the mission objectives of the missile 10.

These conventional guidance systems include, but are not limited to, missile leveling systems, missile inertial navigation system Global Positioning System ("INS/GPS") guidance systems, missile pull-out to level flight guidance systems, missile pull-out for extended range guidance systems, and missile terminal homing guidance systems. As explained, these conventional guidance systems may be employed in conjunction with or instead of the guidance system of the present invention once the level axis 30 has been determined. However, each of these conventional guidance systems preferably utilize the level axis 30 previously determined according to the present invention.

A missile leveling guidance system reorients the missile 10 to align the wings-level axis 20 to the previously determined level axis 30 based upon the orientation of the missile 10 relative to the level axis 30. This reorientation places the missile 10 in a substantially upright orientation (top side facing upward). For winged missiles, this reorientation places the missile 10 in a wings-level orientation.

As is known to those skilled in the art, a missile INS/GPS guidance system preferably includes a GPS receiver integrated with an INS. The INS/GPS guidance system preferably computes an INS/GPS navigation solution and corresponding guidance commands based upon a designated target location. Before employing the INS/GPS guidance system, however, the missile 10 is preferably oriented substantially upright by the guidance system of the present invention such that the GPS antenna which is mounted along the upper surface of the missile 10 is pointed upward and skyward to receive GPS radio frequency signals.

In addition, the guidance system of the present invention may be utilized with missiles which are not designed to impact a target directly, but are instead designed to dispense munitions during its flight. Accordingly, the flight path of the missile 10 may be designed to drop to a relatively low altitude near the target zone according to a drag-only trajectory. Thereafter, a missile pull-out to level flight guidance system may be activated to direct the missile 10 to pull-out from its free-falling trajectory and to fly the missile 10 at a predetermined constant altitude above the ground such that the necessary munitions may be dispensed. Thus, the missile pull-out to level flight guidance system includes a radar altimeter to detect the height of the missile 10 above ground. Prior to employing the missile pull-out to level flight guidance system, however, the guidance system of the present invention preferably orients the missile 10 to an upright or wings-level orientation. In addition, once the missile 10 is flying along the level flight path, the guidance system of the present invention is typically employed in conjunction with the missile pull-out to level flight guidance system of the present invention to provide compensation for dispersion induced by side forces along the level axis 30, but not lift or drag forces.

Furthermore, the guidance system of the present invention may be used with missiles which are capable of gliding or powered flight. Along with the guidance system of the present invention, these missiles may include a missile pull-out for extended range guidance system to pull a missile out of its drag-only trajectory and to hold the missile on a constant glide slope, reducing its rate of descent and increasing its range or stand off. The missile pull-out for extended range guidance system preferably includes an autopilot to maintain a constant lift force on the missile to hold it on a constant glide slope. The constant lift force is equal to the acceleration of the missile due to gravity multiplied by the cosine of the desired flight path angle; i.e., the angle between the velocity vector of the missile 10 and horizontal. Prior to employing the missile pull-out for extended range guidance system for a winged or asymmetric missile, the guidance system of the present invention preferably orients the missile 10 to an upright or wings-level orientation. However, for a symmetric missile, there is no preferred wings-level axis 20 and lift can be generated in any direction perpendicular to the $X_B$ body axis. The vector cross product of the level axis 30 and the $X_B$ body axis define the direction to generate lift to pull-out.

A missile terminal homing guidance system preferably includes a sensor system, such as a radar or infrared sensor system, for locating targets. Prior to employing the missile terminal homing guidance system, however, the guidance system of the present invention preferably orients the missile 10 to an upright orientation. The upright orientation of the missile 10 provides an upright image for the imaging sensors and enables the sensors, which have a limited field of view, to readily locate the target. As known to those skilled in the art, the missile terminal homing guidance system steers the properly oriented missile 10 to the target once the sensor has located the target.

Regardless of the guidance system employed after the level finding means has determined the level axis 30, a missile 10 which has been mounted on the deploying aircraft such that its predetermined wings-level axis is not horizontal may be rotated during flight such that its wings-level axis is aligned with the substantially horizontal level axis. The guidance system of the present invention or a conventional guidance system may thereafter control the flight path of the properly aligned missile 10.

The missile positioning means preferably includes a plurality of control affectors, typically control surfaces, mounted on the exterior of the missile 10 and a plurality of actuating means attached to the plurality of control surfaces for controlling the position of the control surfaces in response to signals generated by the guidance system of the present invention, and, if employed, other guidance systems. As illustrated in FIG. 3, the control surfaces are preferably movable segments 34 which constitute a portion of the outwardly projecting tail fins 32 of the missile 10. The control surfaces 34 may be hingedly connected, along an interior side, to the tail fins 32 of the missile 10 so as to be free to move laterally with respect to the tail fins 32.

The actuating means of the missile positioning means preferably includes a plurality of actuators 36 wherein each actuator is associated with an individual control surface 34. The actuating means also preferably includes means for receiving the signals generated by the guidance system of the present invention and, if employed, other guidance systems, and for transmitting control signals to the plurality of actuators 36 for controlling the position of the plurality of control surfaces 34. The control means for the control surfaces 34 is preferably a controller 38 as illustrated in FIG. 3. The control algorithm by which the controller 38 converts velocity and position error signals into actuator control signals is known to those skilled in the art and need not be described further herein since similar algorithms are utilized by auto-pilot programs in other guided missiles.

As an example of the operation of the control surfaces 34, the controller 38 would lift the trailing edge of the primarily horizontally extending control surfaces **34*a* to force the missile 10 to rotate its nose upward to compensate for downward airflow. Likewise, by turning of the trailing edge of the primarily vertically extending control surfaces 34*b* to port, the missile 10 is forced to rotate its nose to port to compensate for airflow toward the starboard direction. Accordingly, the acceleration on the missile 10** due to the lift and side forces may be negated.

In one embodiment, the plurality of fins 32 extend outwardly from the missile 10 and are spaced at substantially equal angular increments about the periphery of the missile 10. More preferably, the plurality of fins includes four fins 32 spaced about the periphery of the missile 10 at approximately 90° increments as illustrated in FIG. 3. Accordingly, the control surfaces 34, which constitute all or at least a portion of the fins 32, are also spaced in equal angular increments about the periphery of the missile 10.

In operation, the guidance system for controlling the drag-only flight path of a free-falling missile 10 repeatedly detects the acceleration on the missile 10 due to lift and side forces. As explained, the guidance system also repeatedly calculates the velocity and position errors from the detected accelerations. Thereafter, the missile positioning means adjusts the positions of the missile control surfaces 34, preferably via actuators, to compensate for the detected accelerations due to lift and side forces so as to substantially eliminate the velocity and position errors. Thus, by repeating the operations in Blocks 40–50 of FIG. 4A, the guidance system provides continuous dispersion control relative to a drag-only flight path.

Simultaneously, the level finding means repeatedly determines the direction of the $X_B$ axis of the missile 10 and, in turn, determines a substantially horizontal level axis 30 and the orientation of the missile relative to the level axis 30 by repeating the operations in Blocks 52–56 of FIG. 4B. If the missile leveling guidance system is activated and the missile 10 is desired to continue to follow a drag-only flight path, the missile positioning means thereafter further adjusts the control surfaces of the missile 10 in order to align the missile 10 such that its predetermined wings-level axis 20 is aligned with the substantially horizontal level axis 30. If another guidance system is selected after the level axis 30 has been determined as explained herein, the missile positioning means thereafter further adjusts the control surfaces of the missile 10 in a manner appropriate to those other guidance systems.

By repeating this acceleration detection and level axis determination, as well as the adjustment of the control surfaces to compensate for the detected accelerations and to properly align the missile 10, the free-falling missile 10 is internally controlled such that acceptable accuracy of the missile 10 is achieved without initialization of the missile's guidance system from the aircraft or launch platform prior to deployment. This accuracy applies either to the missile impact at the target from a free-fall trajectory or the missile arrival at the desired point in space above the ground to start pull-out to level flight for submunition dispensing. Accordingly, a missile having the guidance system of the present invention may be deployed from an aircraft or other launch platform which does not have a complex data interface since there is no need to download the deployment and target coordinates or additional flight information from the launch platform. In addition, a missile 10 having the guidance system of the present invention does not require a complex sensor system, also known as a seeker system, although the use of such a sensor is not precluded by the present invention should there be a need for additional accuracy or target identification.

Further, since missiles 10 having the guidance system of the present invention will have a controlled flight path, such missiles may be deployed from a relatively great distance from the target in order to provide improved safety in deployment and decreased probability of detection of the deploying aircraft. In addition, missiles having the guidance system of the present invention may be carried at any roll orientation and released from an aircraft at any arbitrary orientation while the aircraft is climbing, diving or turning. Thus, the orientation and flight path angle of the aircraft at the time of release of the missile are not limited by the guidance system of the present invention.

In the drawings and specification, there have been disclosed typical preferred embodiments of the invention and, although specific terms are employed, the terms are used in a generic and descriptive sense only and not for purposes of limitation, the scope of the invention being set forth in the following claims.

That which is claimed:

1. A guidance system for controlling the flight path of a missile, the guidance system comprising:

means for measuring lift and side forces due to external airflow, said measuring means comprising dispersion detection means for detecting acceleration of said missile due to the lift and side forces, said dispersion detection means further comprising means for calculating velocity error and position errors from the detected acceleration due to the lift and side forces; and means for compensating for the measured lift and side forces such that effects of the lift and side forces are substantially eliminated, said compensating means comprising missile positioning means, responsive to said dispersion detection means, for controlling the orientation and position of the missile such that the velocity and position errors are canceled, whereby the position of a free-falling missile may be internally controlled by the missile to increase the accuracy of such missiles without initialization of the missile from a launch platform.

2. A guidance system for controlling the flight path of a missile according to claim 1 wherein the orientation of the missile at its activation establishes $X_R$, $Y_R$ and $Z_R$ mutually perpendicular reference axes and the orientation of the missile during flight establishes $X_B$, $Y_B$ and $Z_B$ mutually perpendicular body axes such that the $X_B$ body axis extends forward along the longitudinal axis of the missile, and wherein said dispersion detection means includes a plurality of accelerometers mounted on the missile for measuring the acceleration along the $Y_B$ axis due to side forces and along the $Z_B$ axis due to lift forces.

3. A guidance system for controlling the flight path of a missile according to claim 2 wherein said dispersion detection means further comprises acceleration integration means for repeatedly integrating the acceleration measured along the $Y_B$ and $Z_B$ axes to determine the velocity and position errors along the $X_R$, $Y_R$, and $Z_R$ axes relative to a drag-only flight path.

4. A guidance system for controlling the flight path of a missile according to claim 1 wherein the missile has a predetermined wings-level axes, the guidance system further comprising:

level finding means for determining a substantially horizontal level axis; and missile positioning means responsive to said level finding means for controlling the orientation of the missile such that the wings-level axis is aligned with the level axis.

5. A guidance system for controlling the flight path of a missile according to claim 4 wherein the orientation of the missile at its deployment establishes $X_R$, $Y_R$, and $Z_R$ mutually perpendicular references axes and the orientation of the missile during flight establishes $X_B$, $Y_B$, and $Z_B$ mutually perpendicular body axes such that the $X_B$ body axis extends forward along the longitudinal axis of the missile, and wherein said level finding means includes a plurality of gyroscopes mounted on the missile for repeatedly determining the direction of the $X_B$ body axis relative to the $X_R$, $Y_R$, and $Z_R$ reference axes such that the plurality of $X_B$ body axes measured over time define a plane in which the missile is falling.

6. A guidance system for controlling the flight path of a missile according to claim 5 wherein the level axis is perpendicular to the plane defined by the plurality of measured $X_B$ body axis.

7. A guidance system for controlling the flight path of a missile according to claim 4 wherein said dispersion detection means includes means for generating signals indicative of the velocity and position errors due to the lift and side forces and said level finding means includes means for generating signals indicative of the direction of the level axis and signals indicative of the orientation of the missile relative to the level axis.

8. A guidance system for controlling the flight path of a missile according to claim 7 wherein said missile positioning means includes a plurality of control surfaces and a plurality of actuating means attached to said plurality of control surfaces for controlling the position of said control surfaces in response to the signals generated by said dispersion detection means.

9. A guidance system for controlling the flight path of a missile according to claim 8 wherein said actuating means further includes a plurality of actuators wherein each actuator is associated with an individual control surface and actuator control means for receiving the signals generated by said dispersion detection means and for transmitting control signals to said plurality of actuators for controlling the positions of said plurality of control surfaces.

10. A guidance system for controlling the flight path of a missile according to claim 9 wherein said plurality of control surfaces extend outwardly from the missile and are spaced at substantially equal angular increments about the periphery of the missile.

11. A guidance system for controlling the flight path of a missile according to claim 1 wherein the missile is launched from an aircraft, and wherein the missile is free of all electrical power and signal connections to the aircraft.

12. A guidance system for controlling the flight path of a missile adapted to be carried by and deployed from an aircraft during flight, wherein the missile has a predetermined wings-level orientation defining a wings-level axis, and wherein the orientation of the missile at its activation establishes $X_R$, $Y_R$ and $Z_R$ mutually perpendicular reference axes and the position of the missile during flight establishes $X_B$, $Y_B$ and $Z_B$ mutually perpendicular body axes such that the $X_B$ body axis extends forward along the longitudinal axis of the missile, the guidance system comprising:

a plurality of accelerometers for measuring the acceleration along the $Y_B$ axis due to side forces from external airflow and along the $Z_B$ axis due to lift forces from external airflow;

a plurality of gyroscopes for repeatedly determining the direction of the $X_B$, $Y_B$, and $Z_B$ body axes as relative to the $X_R$, $Y_R$, and $Z_R$ reference axes such that the plurality of $X_B$ body axis directions computed over time define a plane in which the missile is falling and wherein the orientation of a level axis is defined perpendicular to the plane defined by the plurality of computed $X_B$ body axis directions;

acceleration integration means for resolving the accelerations measured along the $Y_B$ and $Z_B$ axes onto the $X_R$, $Y_R$ and $Z_R$ reference axes and for repeatedly integrating the resolved accelerations to determine the velocity and position errors along the $X_R$, $Y_R$, and $Z_R$ axes with respect to a drag-only trajectory;

means for generating signals indicative of the velocity and position errors due to the lift and side forces, and signals indicative of the orientation of the level axis, and the orientation of the missile relative to the level axis; and missile positioning means responsive to said signal generating means for controlling the position of the missile such that the wings-level axis is aligned with the level axis and the velocity and position errors are canceled such that the acceleration of the missile due to the lift and side forces is substantially eliminated, whereby the position of a free-falling missile may be internally controlled by the missile to increase the targeting accuracy of the missile without initialization of the missile from the aircraft.

13. A guidance system for controlling the flight path of a missile according to claim 12 wherein said missile positioning means includes a plurality of control surfaces and a plurality of actuating means attached to said plurality of control surfaces for controlling the position of said control surfaces in response to signals from said signal generating means.

14. A guidance system for controlling the flight path of a missile according to claim 13 wherein said actuating means further includes a plurality of actuators wherein each actuator is associated with an individual control surface and actuator control means for receiving a signal from said signal generating means and for transmitting control signals to said plurality of actuators for controlling the positions of said plurality of control surfaces.

15. A guidance system for controlling the flight path of a missile according to claim 14 wherein said plurality of control surfaces extend outwardly from said missile and are spaced at substantially equal angular increments about the periphery of the missile.

16. A method for internally guiding a free-falling missile comprising the steps of:

deploying the missile from a launch platform;

detecting the acceleration on the missile due to lift and side forces from external airflow;

calculating velocity errors and position errors from the detected acceleration due to the lift and side forces; and controlling the position of the missile such that the acceleration of the missile due to the lift and side forces is substantially eliminated, whereby the internal guidance of the missile increases a targeting accuracy of the missile without initialization of the missile from the launch platform.

17. A method for internally guiding a free-falling missile according to claim 16 further comprising the steps of:

initializing the direction of mutually perpendicular reference axes $X_R$, $Y_R$ and $Z_R$ based upon the orientation of the missile at activation; and repeatedly computing the orientation of mutually perpendicular body axes $X_B$, $Y_B$ and $Z_B$ based upon the position of the missile during flight, relative to the $X_R$, $Y_R$ and $Z_R$ references axes, such that the $X_B$ body axis extends forward along the longitudinal axis of the missile.

18. A method for internally guiding a free-falling missile according to claim 17 wherein the missile has a predetermined wings-level orientation defining a wings-level axis, wherein the repeatedly computed $X_B$ body axis orientations define both a plane in which the missile is falling and a level axis perpendicular to the plane, and wherein said controlling step comprises the step of controlling the position of the missile such that the wings-level axis is aligned with the level axis and the velocity and position errors are canceled.

19. A method for internally guiding a free-falling missile according to claim 17 wherein said calculating step further comprises the step of repeatedly integrating the acceleration measured along the $Y_B$ and $Z_B$ body axes to determine velocity and position errors along the $X_R$, $Y_R$, and $Z_R$ axes.

20. A method for internally guiding a free-falling missile according to claim 19 wherein the missile has a predetermined wings-level position, the method further comprising the step of determining a substantially horizontal level axis during flight.

21. A method for internally guiding a free-falling missile according to claim 20 wherein the level axis determining step further comprises the step of repeatedly determining the direction of the $X_B$ body axis relative to the $X_R$, $Y_R$, and $Z_R$ reference axes such that the plurality of $X_B$ body axes measured over time define a plane in which the missile is falling and the level axis is perpendicular to the plane in which the missile is falling.

22. A method for internally guiding a free-falling missile according to claim 20 wherein the acceleration detecting step further comprises the step of generating signals indicative of the velocity and position errors due to the lift and side forces and wherein the level axis determining step further includes the step of generating signals indicative of the orientation of the level axis and the orientation of the missile relative to the level axis.

23. A method for internally guiding a free-falling missile according to claim 22 wherein the missile includes a plurality of outwardly extending control surfaces, and wherein the position controlling step includes the step of controlling the position of the control surfaces in response to the signal generated indicative of the velocity and position errors and the orientation of the missile relative to the level axis.

* * * * *